US007757846B2

(12) United States Patent
Blome et al.

(10) Patent No.: US 7,757,846 B2
(45) Date of Patent: Jul. 20, 2010

(54) FOLDING CIGARETTE PACKET

(75) Inventors: Hermann Blome, Blender-Einste (DE); Viktor Hein, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 180 days.

(21) Appl. No.: 11/569,292

(22) PCT Filed: Oct. 28, 2004

(86) PCT No.: PCT/EP2004/012210

§ 371 (c)(1),
(2), (4) Date: Nov. 17, 2006

(87) PCT Pub. No.: WO2005/115852

PCT Pub. Date: Dec. 8, 2005

(65) Prior Publication Data

US 2007/0221517 A1 Sep. 27, 2007

(30) Foreign Application Priority Data

May 19, 2004 (DE) ..... 10 2004 025 261

(51) Int. Cl.
*B65D 85/10* (2006.01)

(52) U.S. Cl. ..... 206/271; 206/268; 206/259; 206/261

(58) Field of Classification Search ..... 206/261, 206/268, 273, 271, 242, 259; 229/122.32, 229/160.1; D27/186
See application file for complete search history.

(56) References Cited

U.S. PATENT DOCUMENTS 3,079,064 A 2/1963 Ringler
3,327,888 A * 6/1967 Walker ..... 206/268
5,207,322 A * 5/1993 Focke et al. ..... 206/268
5,366,077 A * 11/1994 Pham ..... 206/268
5,586,648 A * 12/1996 Focke et al. ..... 206/264
5,738,207 A * 4/1998 Trimani ..... 206/268
5,749,462 A * 5/1998 Houghton ..... 206/268
5,896,984 A * 4/1999 Focke et al. ..... 206/268
5,904,244 A * 5/1999 Focke et al. ..... 206/268
6,220,430 B1 4/2001 Boriani
6,302,322 B1 * 10/2001 Focke et al. ..... 229/160.1
6,334,532 B1 * 1/2002 Tambo et al. ..... 206/268
6,360,943 B1 * 3/2002 Focke et al. ..... 229/160.1
6,457,580 B1 * 10/2002 Focke et al. ..... 206/259
6,591,982 B2 * 7/2003 Focke et al. ..... 206/259

(Continued)

FOREIGN PATENT DOCUMENTS

DE 1 008 196 5/1957

(Continued)

*Primary Examiner*—J. Gregory Pickett
*Assistant Examiner*—King M Chu
(74) *Attorney, Agent, or Firm*—Sughrue Mion, PLLC

(57) ABSTRACT

In order to manufacture folding packets having a packet part (11), a lid (12) and a collar (13), a single-piece blank is used, in which a collar (13) is connected to a main blank (14) via connecting webs (15, 16). The collar (13) is connected to a connecting web (15) via an edge-side collar folding line, and the connecting webs (15, 16) are connected to the main blank (14) via transversely oriented web folding lines (41, 42), with the result that the collar (13) can be moved into the position with two folding steps which follow one another.

9 Claims, 9 Drawing Sheets

U.S. PATENT DOCUMENTS

Figure 1:
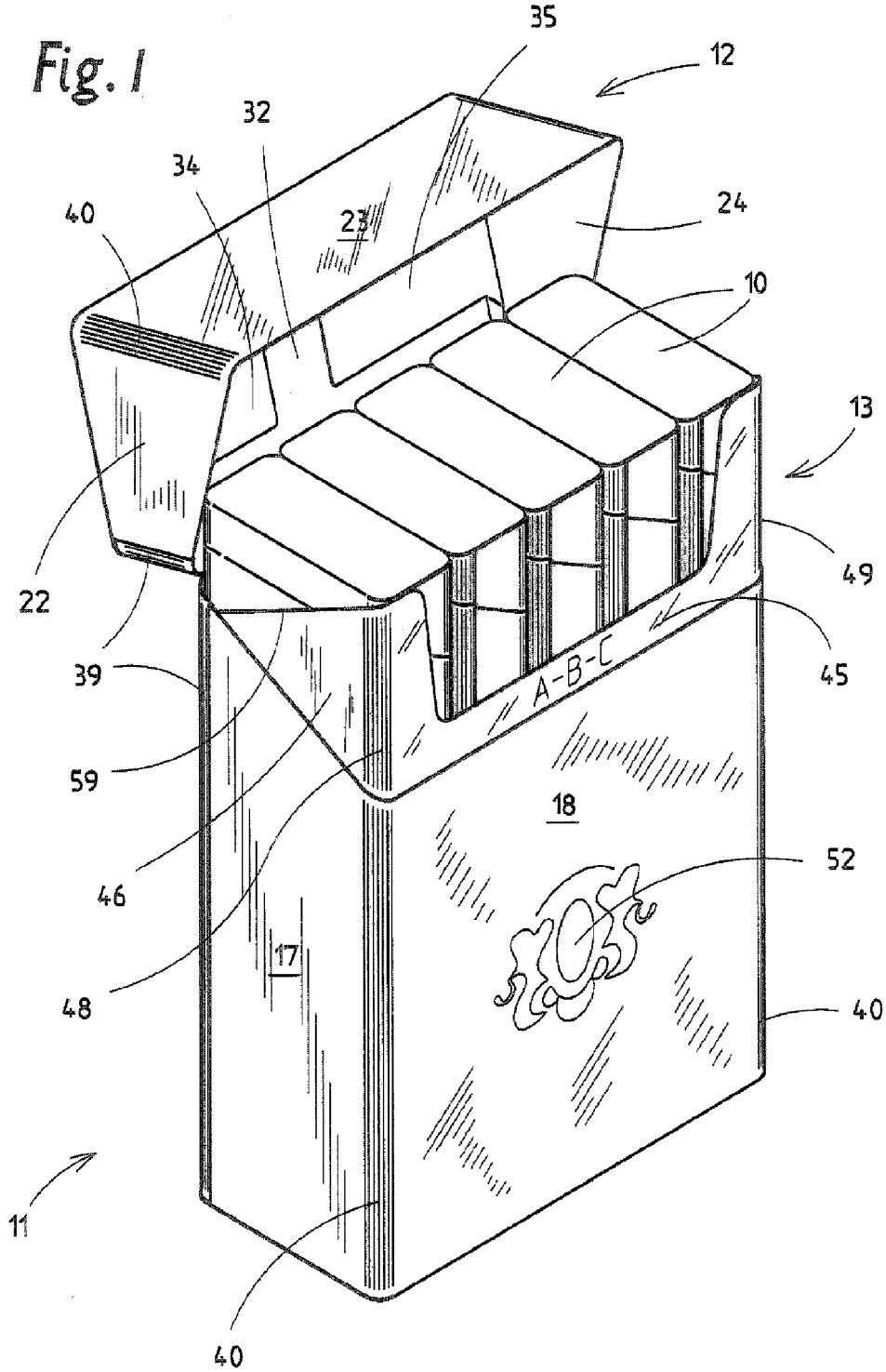

| | | | |
|---|---|---|---|
| 2003/0183541 | A1 | 10/2003 | Draghetti |
| 2004/0050726 | A1 | 3/2004 | Boriani |

FOREIGN PATENT DOCUMENTS

| | | | |
|---|---|---|---|
| DE | 2 135 776 | | 2/1973 |
| DE | 199 12 995 | A1 | 9/2000 |
| EP | 1 086 909 | A1 | 3/2001 |
| EP | 925 228 | B1 | 2/2002 |
| GB | 2 139 192 | | 11/1984 |
| WO | WO 02/051719 | A1 | 7/2002 |

* cited by examiner 35
12
32
34
40
23
24
10
13
22
49
39
45
A-B-C
59
18
46
52
17
48
40
11
40

17
40
42
34
26
33
52
18
38
40
35
19
14
41
32
20
37
39
25
21
13

12
13
40
52
42
16
56
53
46
58
34
17
26
14
33
23
18
38
43
54
45
35
24
19
15
47
29
32
20
37
41
44
57
25
30
21
39
13

12
24
47
19
57
11
15
41
32
35
33
25
29
13
20
37
38

12
25
30
29
58
62
11
21
20
37
33
46
16
38
32
34
59
23
45
56
43
18
17

34
25
29
13
46
20
56
37
33
32
38
12
22
17
43
11
39
16
42

FOLDING CIGARETTE PACKET

DESCRIPTION

The invention relates to a folding packet, in particular a bundle pack for cigarettes, comprising a single-piece blank for forming a packet part, a lid and a collar, the collar being connected via at least one connecting web to the packet part of the blank, and it being possible for the collar to be folded against the inner side of the blank via at least one (web) folding line of the connecting web, which (web) folding line extends transversely with respect to vertical pack edges.

Folding packets comprising single-piece blanks, in which therefore the collar is connected to the blank for the folding packet, are known. EP 0 925 228 B1 shows one example. The collar is connected via (two) connecting webs to a front wall of the packet part. In order to move the collar into a relative position which corresponds to the pack, the connecting webs are folded in a Z-shaped manner. This folding step is difficult to handle in the packing machines with high performance which are customary for cigarettes.

The invention is based on the object of proposing a folding packet or a blank for a folding packet of this type, in which the collar is connected in one piece to the blank of the folding packet, but can be moved into the position according to the pack by simple folding steps during the manufacture of the pack.

In order to achieve this object, the folding packet according to the invention is characterized in that the collar is connected to the connecting web via a folding line, collar folding line, which extends on an outer boundary or an outer edge of the collar, and in that the collar can be folded in two folding steps which follow one another into a position according to the packet on an inner side of the blank.

Accordingly, in accordance with the invention, the collar is folded into the customary position on the inner side of a packet front wall and adjacent packet side walls in two folding steps which follow one another (spatially and temporally). This is only possible if the collar folding line for delimiting the collar with respect to the connecting web is attached at an outermost edge of the collar and has no projections which protrude beyond the collar folding line.

The blank or the folding packet is preferably configured in such a way that (two) connecting webs for holding the collar are connected to the blank via web folding lines which are oriented transversely with respect to the vertical pack edges, and the collar is connected to one of the connecting webs via a collar folding line which is oriented transversely with respect thereto, namely extends in the direction of the pack edges. One embodiment is particularly favorable, in which a connecting web for holding the collar is connected to a central packet side wall and the collar adjoins this connecting web laterally.

The invention can also be used in folding packets, in which the lid (exclusively) is connected pivotably to the packet part in the region of a (narrow) side wall. In this case, the collar is of particular configuration and is attached to the connecting webs.

Further features of the invention relate to the design of the connecting webs and the design of the collar.

Figure 2:
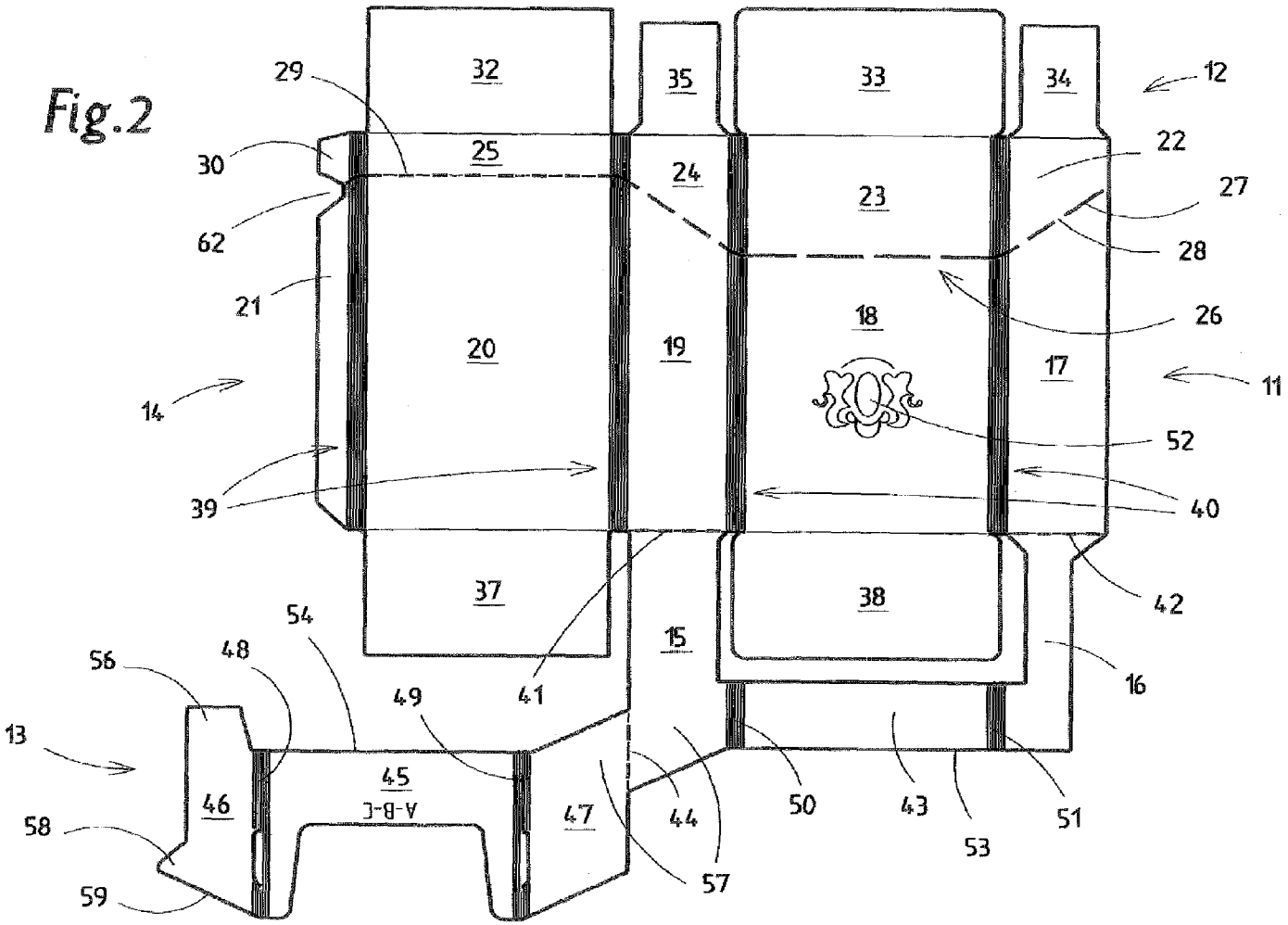
Figure 4:
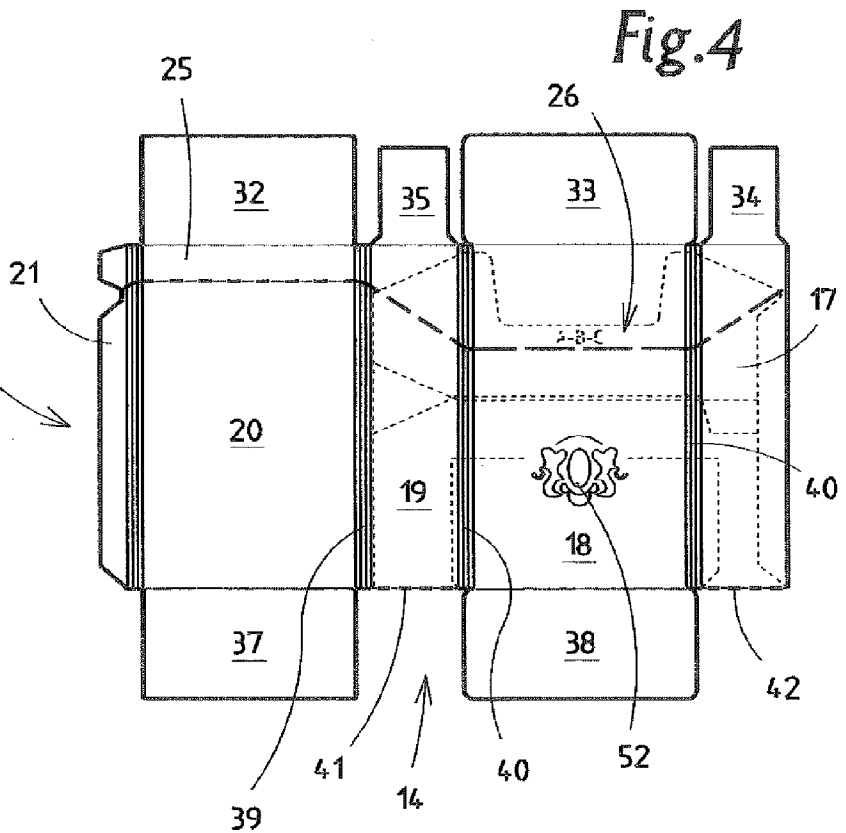
Figure 3:
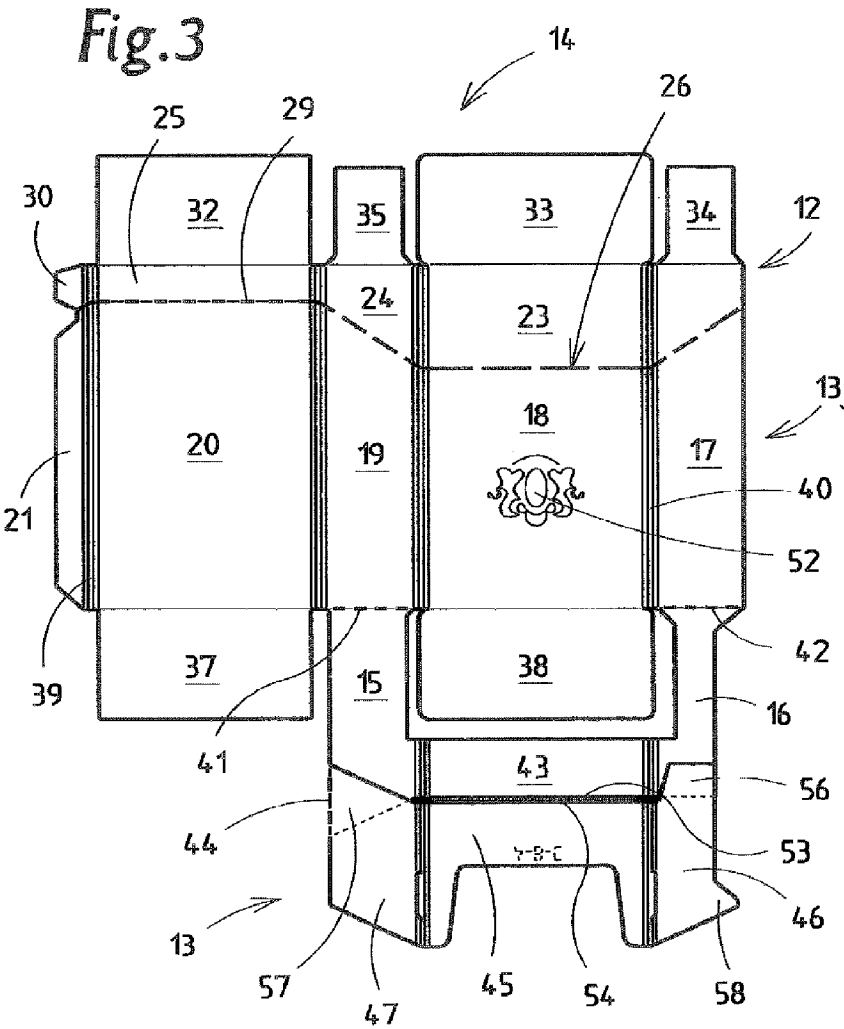
Figure 5:
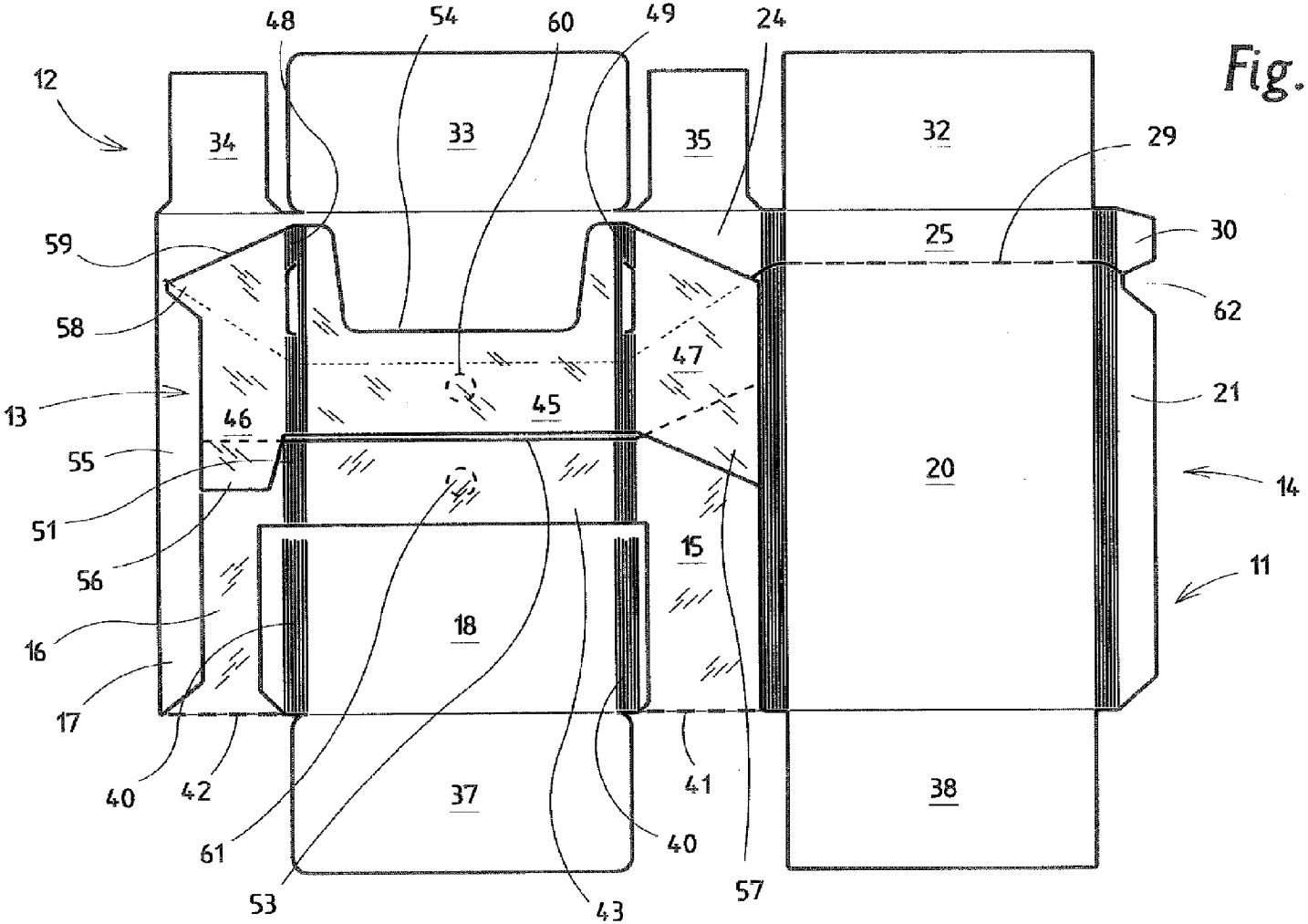
Figure 6:
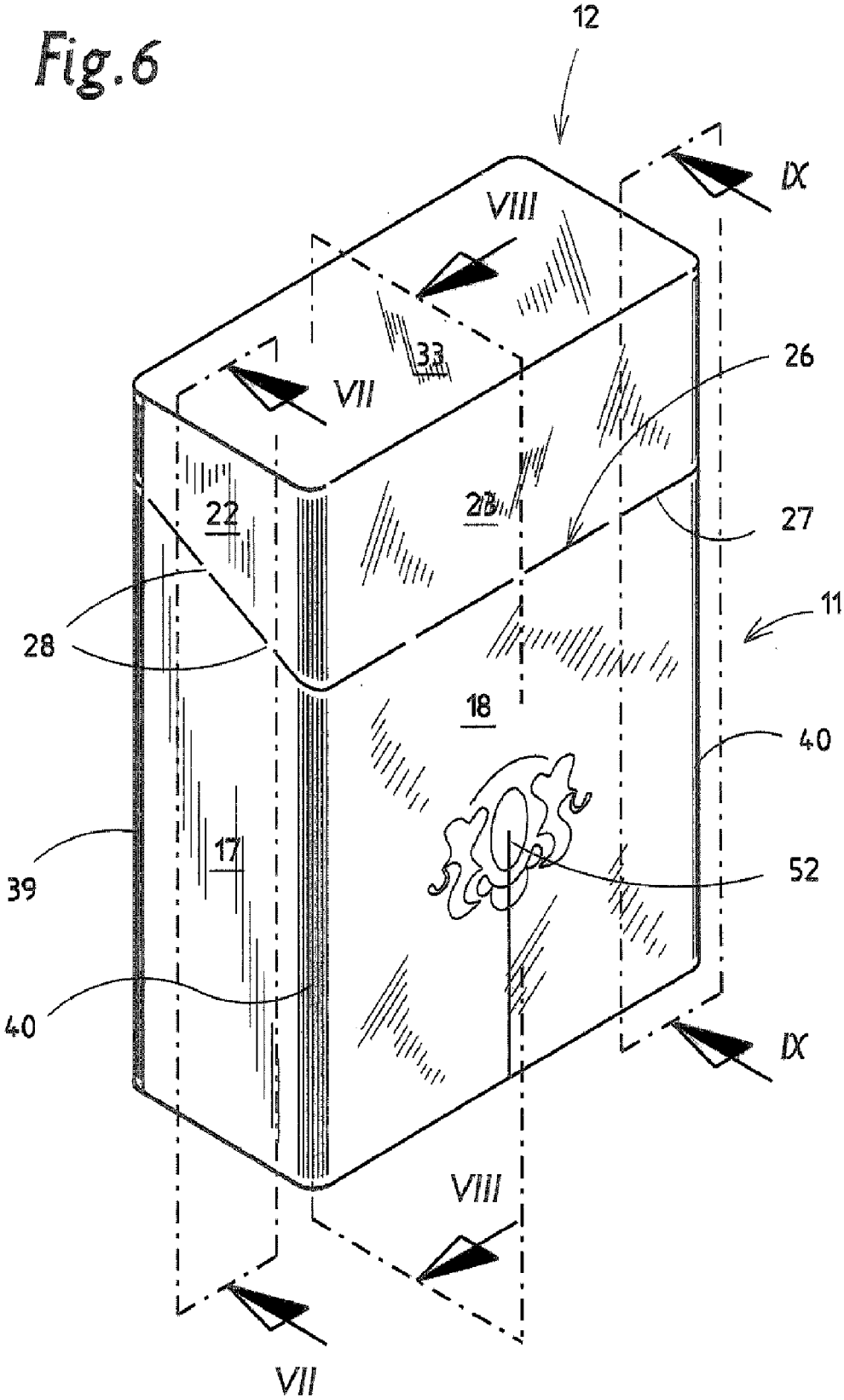
Figures 7, 8, 9:
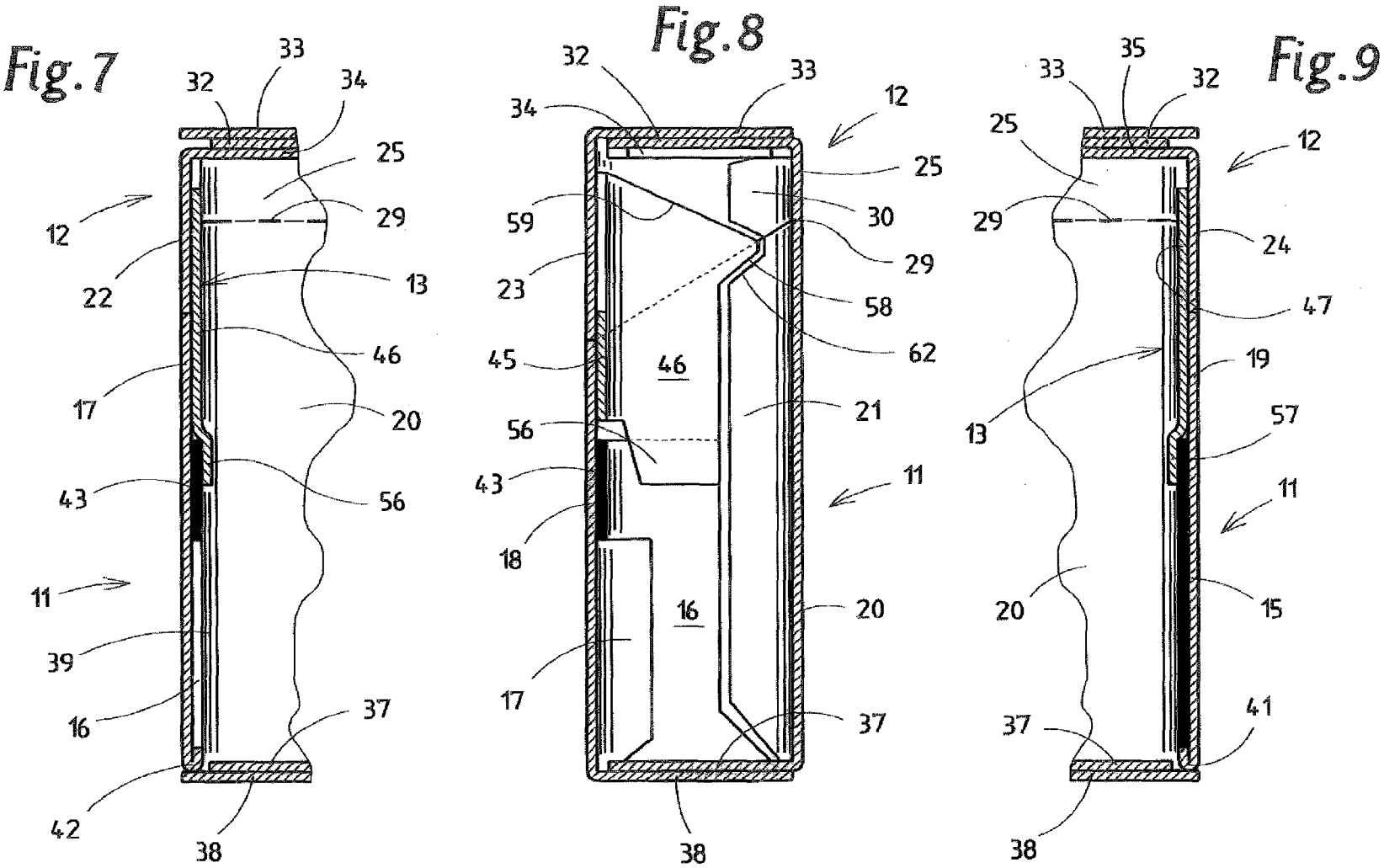
Figure 11:
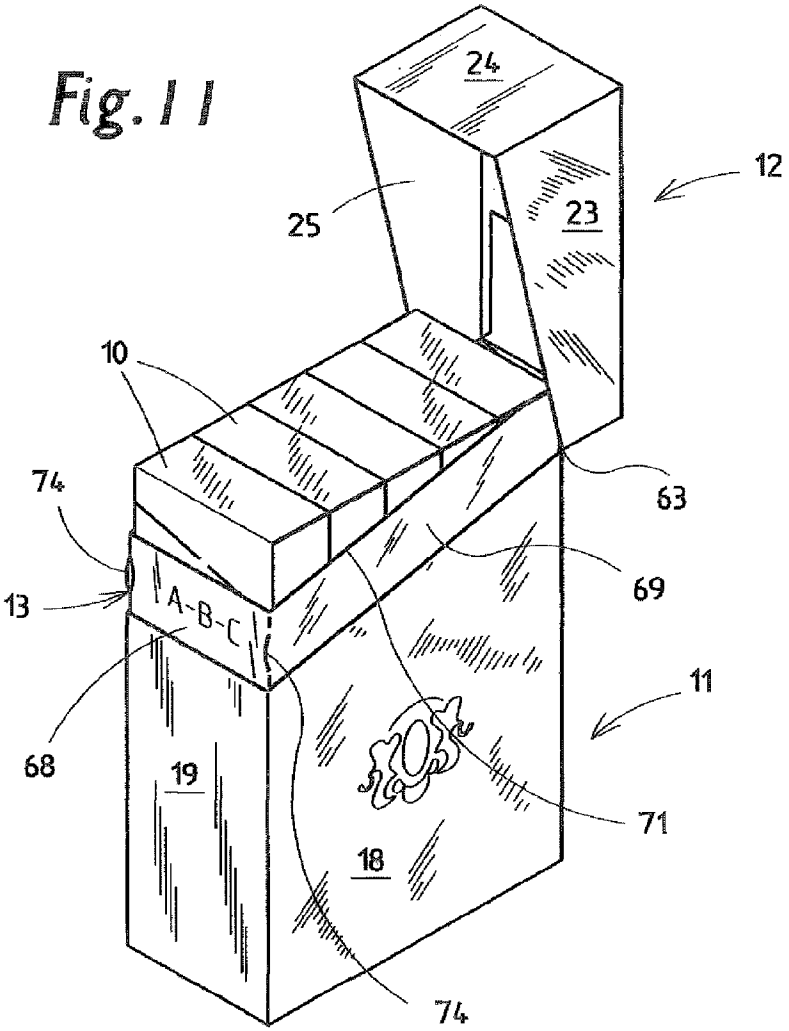
Figure 10:
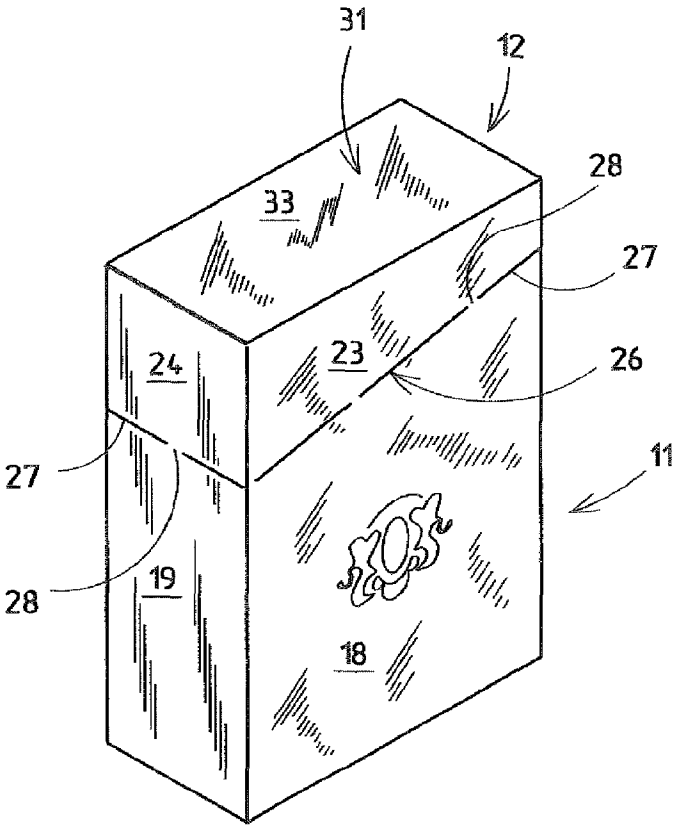
Figure 12:
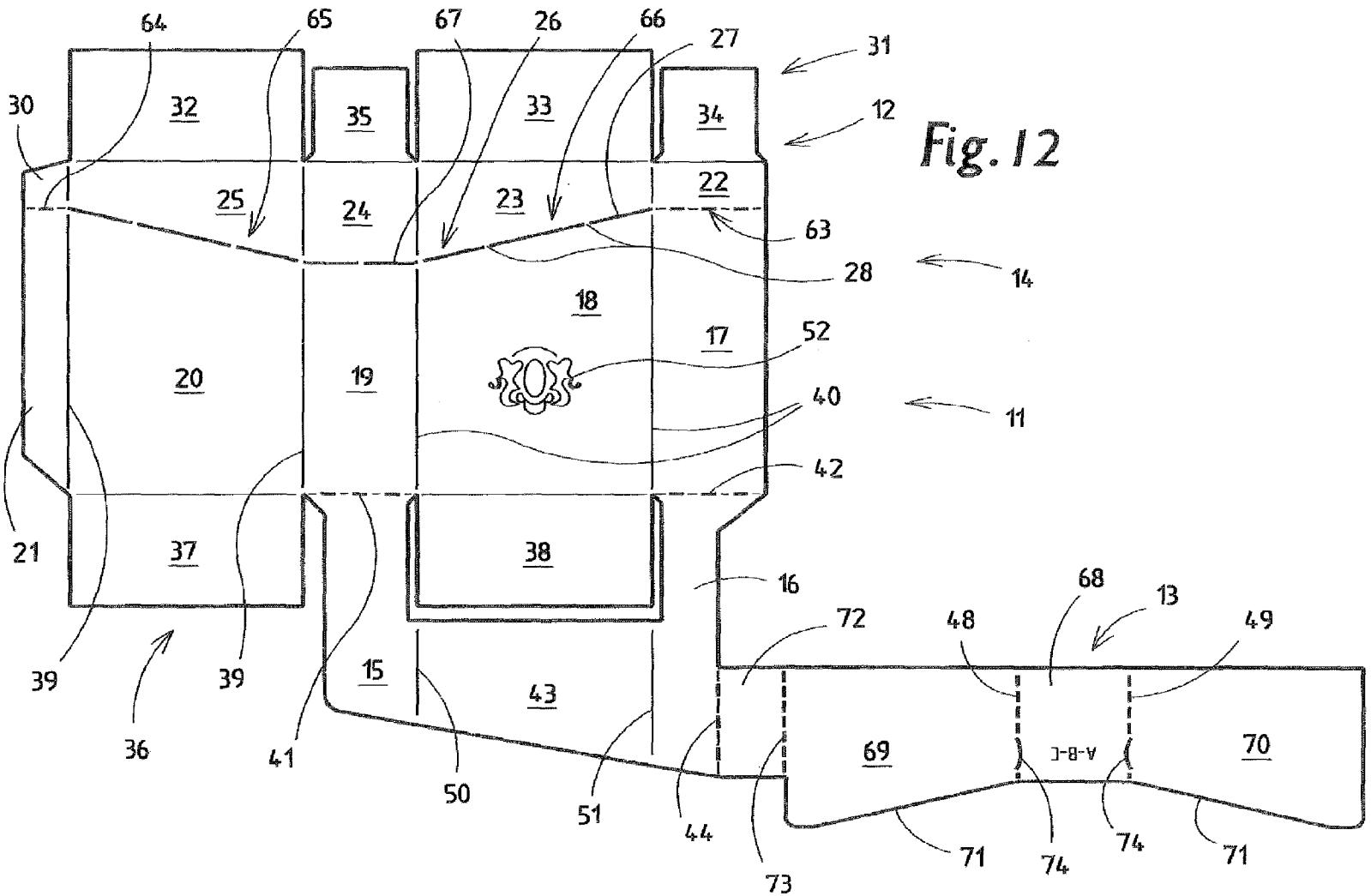
Figure 13:
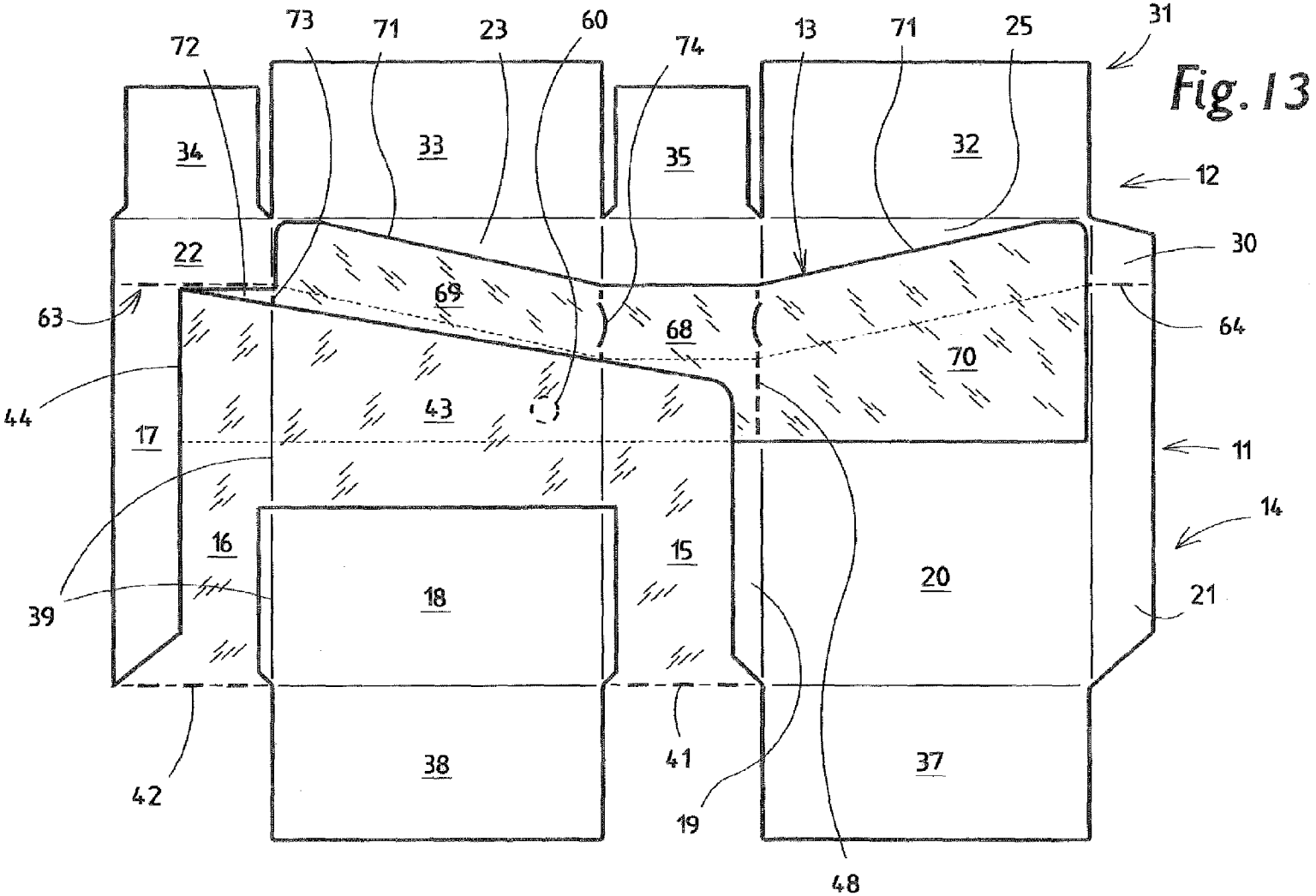

Exemplary embodiments of the folding packet according to the invention will be explained in greater detail in the following text using the drawings, in which:

FIG. 1 shows a folding packet, namely a bundle pack, in a perspective illustration, with an open lid, FIG. 2 shows a spread-out blank for a folding packet according to FIG. 1, in a view from the outside, FIG. 3 shows the blank according to FIG. 2, after a first folding step, FIG. 4 shows the blank according to FIG. 2 and FIG. 3, after a second folding step, FIG. 5 shows the blank according to FIG. 4 in a view from the inside, on an enlarged scale, FIG. 6 shows the folding packet according to FIG. 1 in the closed position, in a perspective illustration, FIG. 7 shows a vertical partial section through the pack according to FIG. 6, namely in the sectional plane VII-VII, FIG. 8 shows an (approximately) central vertical section of the pack according to FIG. 6, in the sectional plane VIII-VIII, FIG. 9 shows a further vertical section through the pack according to FIG. 6, in the sectional plane IX-IX, FIG. 10 shows a folding packet having a lid which can pivot in the transverse direction, in a perspective illustration, with a closed lid, FIG. 11 shows the folding packet according to FIG. 10, with an open lid, FIG. 12 shows a complete blank for a folding packet according to FIG. 10 and FIG. 11, in a spread-out form, and FIG. 13 shows the blank according to FIG. 12 in an intermediate folding position, to be precise as viewed from the rear side.

The drawings show exemplary embodiments of folding packets for cigarettes, to be precise bundle packs for accommodating a group of cigarette packs 10 which are likewise configured as folding packets The folding packet comprises, in a standard manner, a (lower) packet part 11, a lid 12 and a collar 13. A blank for the manufacture of folding packets of this type is configured in one piece (FIG. 2, FIG. 12). The collar 13 is connected to a main blank 14, to be precise via at least one, in the present exemplary embodiments via two connecting webs 15, 16.

The main blank 14 is constructed according to the principle of transverse folding. Walls for the packet part 11 on one side and the lid 12 on the other side lie next to one another in the transverse direction, namely a (first) packet side wall 17, a packet front wall 18, a (second) packet side wall 19 and a packet rear wall 20. The packet side wall 17 is an edge-side folding tab which is connected to a peripheral tab 21 by means of glue in the folded folding packet, which peripheral tab 21 is arranged so as to lie opposite on the packet rear wall 20.

Walls of the lid 12 adjoin the walls of the packet part 11. Correspondingly, the lid side wall 22, the lid front wall 23, the lid side wall 24 and the lid rear wall 25 are accordingly arranged next to one another. The packet part 11 and the lid 12 are connected to one another in the region of the blank and until first opening of the lid 12 by punching or perforation lines, as far as regions of a linear articulation The drawings show two different embodiments of folding packets, namely firstly according to FIG. 1 to FIG. 9 and secondly according to FIG. 10 to FIG. 13. In the first exemplary embodiment, there is a weakening or perforation line 26 between the packet part 11 and the lid 12 comprising punch cuts 27 and residual connections 28. The perforation line 26 is oriented obliquely in the region of the side walls 17, 19 and 22, 24, in a manner which extends horizontally in the region of the front walls 18, 23, in accordance with the contour of closing edges between the packet part 11 and the lid 12 which are customary in folding packets. The package rear wall 20 is connected to the lid rear wall 25 by a transversely oriented linear articulation 29. The peripheral tab 21 is complemented in the region of the lid 12 by a lid peripheral tab 30 which is connected to the lid side wall 22.

An end wall 31 of the lid 12 comprises an inner tab 32 (on the lid rear wall 25), an outer lid tab 33 (on the lid front wall 23) and side tabs 34, 35 (in each case on the lid side walls 22 and 24). Folding tabs for a bottom wall 36 are arranged on the main blank 14 so as to lie opposite one another, namely an inner tab 37 and a lid tab 38, and are connected in each case to the packet rear wall 20 and the packet front wall 18.

The vertical walls of the packet part 11 and the lid 12 are delimited with respect to one another on the front and rear side by vertical pack edges 39 and 40. In the present particular exemplary embodiment, these are configured as round edges, namely with a quadrant-shaped cross-sectional shape with adaptation to the dimensions of the cigarettes or to round edges of the cigarette packs 10 which form the pack contents. The pack edges 39, 40 are formed in each case by a number of parallel, embossed grooves.

The collar 13 is connected to the main blank 14 via at least one connecting web 15, in the present example by the two connecting webs 15 and 16. The connecting webs 15, 16 extend as a continuation of the packet side walls 17, 19 and are connected to the associated packet side walls 17, 19 via folding lines, namely web folding lines 41, 42, which are oriented transversely with respect to the pack edges 39, 40. After folding of the connecting webs 15, 16, they bear against the associated walls 17, 19 on the inner side, to be precise exclusively in the region between the rounded portions of the pack edges 39, 40 on account of corresponding dimensioning.

The connecting webs 15, 16 which extend on both sides of a folding tab of the bottom wall 36, namely the lid tab 38, are connected to one another by a transverse web 43 outside the region of the lid tab 38. Said transverse web 43 forms a U-shaped connecting unit for the collar 13 with the connecting webs 15, 16.

The collar 13 is connected to the connecting unit via a folding line which is arranged on an outer edge of said collar 13, namely with a collar folding line 44. The latter extends in the direction of the pack edges 39, 40, that is to say transversely with respect to the web folding lines 41, 42. The collar 13 which comprises a collar front wall 45 and lateral collar tabs 46, 47 is connected to the connecting web 15 which lies in the center of the main blank 14 in the region of a vertical, outer peripheral edge of one collar tab 47, to be precise likewise at the edge of this connecting web 15. The collar front wall 45 is delimited with respect to the collar tabs 46, 47 by collar edges 48, 49 which are likewise configured as round edges. Furthermore, in the region of the transverse web 43, the connecting unit has folding edges 50, 51 which are configured as round edges, extend as a continuation of the front-side pack edges 40 and bear against the latter on the inside in the finished pack.

The blank for the folding packet is configured in such a way that only one side has printing or a coating, namely the outer visible side of the folding packet. In order to identify this outer visible side, an emblem 52 in the region of the packet front wall 18 is shown in the region of the blank. The collar 13 likewise has labeling of the visible side, namely with the letters A-B-C. In the finished pack (FIG. 1), the visible side A-B-C, as shown, of the collar should point outward. For this purpose, the collar 13 is moved into the position according to the pack (FIG. 5) in two folding steps which follow one another temporally and spatially The procedure is expediently such that, first of all, the collar 13 is folded along the collar folding line 44, in such a way that the collar 13 lies in the region of the connecting unit 15, 16, 43 (FIG. 3) As can be seen, the collar 13 is dimensioned and designed in such a way that its width corresponds to the width of the connecting unit. The height of the collar front wall 45 is configured in such a way that a free outer edge 53 of the connecting unit lies (approximately) flush with a lower edge 54 of the collar front wall 45 on account of the relative position (FIG. 3).

After the first folding step, the connecting webs 15, 16 with the collar 13 are folded along the web folding lines 41, 42 until they come into contact with the inner side of the main blank 14. FIG. 4 shows this folding position from the (printed) visible side of the blank, and FIG. 5 shows the same folding position in a rear view of the blank. After these (two) folding steps, the collar 13 is positioned on the (unprinted) inner side of the main blank 14 in the position according to the pack. The printed side A-B-C of the collar 13 is situated on the same side as the printed side of the main blank 14.

The collar 13 and the connecting webs 15, 16 are adapted to one another in a particular manner. The connecting web 15 is extended to such an extent that there is a connection in the region of the collar folding line 44 in a part region of the collar tab 47. The collar tab 46 which lies opposite has a considerably smaller width than the associated packet side wall 17 and lid side wall 22. In a corresponding manner, the connecting web 16 is also configured with a reduced width, with the result that a strip 55 of the packet side wall 17 remains free on the edge side when these blank parts 16, 46 are in contact with the inner side of the side wall 17, 22. It is possible to join the peripheral tab 21 directly to the packet side wall 17 in this region by adhesive bonding, in such a way that the peripheral tab 21 lies in the same plane as the collar tab 46 and the connecting web 16. The collar tab 46 is provided with an extension 56 which is directed downward in the folding position and bears against the connecting web 16 on the inner side. On the opposite side, there is a corresponding overlap of the collar tab 47 with the connecting web 15 in the region of a triangular overlap 57.

In the upper region, the collar tab 46 has a projection 58 which is directed laterally, here in a triangular contour. This projection 58 forms a part of an upper oblique edge 59 of the collar tab 46. As can be seen from FIG. 1, this oblique edge 59 extends over (approximately) the full width of the side wall 17, 22, in a manner which falls away to the rear side of the pack.

At the edge of the packet side wall 17 or lid side wall 22, the projection 58 enters into an approximately triangular recess 62 between the peripheral tab 21 and the lid peripheral tab 30 (FIG. 8), with the result that there is also an overall two-layer formation in this region.

In order to provide increased stability, the collar and/or the connecting unit are/is joined to the inner side of the main blank 14, to be precise to the packet front wall 18, by adhesive bonding. The collar front wall 45 and the transverse web 43 are fixed to the inner side of the packet front wall 18 in each case via one spot of glue 60, 61.

The folding packet according to FIG. 10 to FIG. 13 is configured in such a way that the linear articulation 63 is formed in the region of a (narrow) packet side wall 17 or lid side wall 22. The arrangement is made in such a way that the edge-side packet side wall 17 and the associated lid side wall 22 have the transversely oriented linear articulation 63. In the finished pack, the side wall 17/22 is connected to the peripheral tab 21 or the lid peripheral tab 30. The linear articulation also extends in the region of these peripheral tabs 21/30, namely with a part articulation 64 as an extension of the linear articulation 63.

The perforation line 26 for delimiting the packet part 11 and the lid 12 comprises in each case one section 65, 66 in the region of the pack front side 18/23 or the pack rear side 20/25. The two sections extend in a straight line in a downwardly directed manner from the ends of the linear articulation 63 or part articulation 64 to a transverse section 67 of the perforation line 26 in the region of the side wall 19/24. The lid 12 is expediently opened starting from the transverse sections 67.

The collar 13 is also configured in a particular manner in this exemplary embodiment, and namely extends continuously in the region of the packet side wall 19 and the adjacent pack walls 18, 20. Part regions of the collar 13 are delimited from one another by transversely oriented folding lines in order to define collar edges 48, 49. A comparatively narrow collar end wall 68 is therefore produced which bears against the packet side wall 19 on the inner side, and two corresponding collar side tabs 69, 70 are also produced which bear against the packet front wall 18 or packet rear wall 20. The collar side tabs 69, 70 have in each case upper collar edges 71 which fall away to the end wall 68, The collar 13 is connected to a connecting web 15 or 16, in the present case to a U-shaped unit comprising two connecting webs 15, 16 and a transverse web 43. This connecting piece 15, 16, 43 is configured in an analogous manner to the exemplary embodiment according to FIG. 1 to FIG. 9. The transverse web 43 is designed in a deviating manner in a trapezoidal configuration with adaptation to the contour of the perforation line 26. Furthermore, it is particular that the collar 13 is connected via an intermediate piece 72 to the (edge-side) connecting web 16 or to the transverse web 43. The intermediate piece 72 ensures the correct relative position of the collar 13 on the inner side of the main blank 14 after the two folding steps which follow one another. One edge of the collar 13 or of the collar side tab 69 is connected via a folding line 73 to the intermediate piece 72.

In the preparation of the overall blank or the manufacture of the folding packet, the procedure in this exemplary embodiment is analogous to that according to FIG. 1 to FIG. 9. First of all, the collar 13 with intermediate piece 72 is folded along the collar folding line 44 against the rear side of the unit 15, 16, 43 or against the rear side of the transverse web 43. In this first folding position, the unprinted or untreated faces of the collar 13 and the transverse web 43 bear against one another. The folding is then carried out along the web folding lines 41, 42, to be precise against the (unprinted) inner side of the main blank 14. FIG. 13 shows this second folding position. The collar 13 is situated between the transverse web 43 and the main blank 14. The printed or treated side of the collar 13 (A-B-C) points in the same direction as the printed side of the main blank. The intermediate piece 72 lies on the inner side of the packet side wall 17, to be precise just below the linear articulation 63. The folding line 73 lies exactly in the region of the (right-angled) pack edge 39 between the packet side wall 17 and the packet front wall 18. The blank which has two or three layers in part regions can then be folded according to the principle of transverse folding.

In order to form a closing aid for the lid 13, C-shaped punchings 74 are made in the region of the collar edges 48, 49 in this exemplary embodiment. These shaped punchings 74 form protruding "ears" in the region of the collar edges 48, 49 which form the closing aid for the lid in a manner which is known per se (FIG. 11).

The exemplary embodiment according to FIG. 10 to FIG. 13 has pack edges 39 which are right-angled in cross section. As an alternative, this embodiment can also be configured with round edges.

LIST OF DESIGNATIONS

10 Cigarette pack
11 Packet part
12 Lid.
13 Collar
14 Main blank
15 Connecting web
16 Connecting web
17 Packet side wall
18 Packet front wall
19 Packet side wall
20 Packet rear wall
21 Peripheral tab
22 Lid side wall
23 Lid front wall
24 Lid side wall
25 Lid rear wall
26 Perforation line
27 Punch cut
28 Residual connection
29 Linear articulation
30 Lid peripheral tab
31 End wall
32 Inner tab
33 Lid tab
34 Side tab
35 Side tab
36 Bottom wall
37 Inner tab
38 Lid tab
39 Pack edge
40 Pack edge
41 Web folding line
42 Web folding line
43 Transverse web
44 Collar folding line
45 Collar front wall
46 Collar tab
47 Collar tab
48 Collar edge
49 Collar edge
50 Folding edge
51 Folding edge
52 Emblems
53 Outer edge
54 Lower edge
55 Strip
56 Extension
57 Overlap
58 Projection
59 Oblique edge
60 Spot of glue
61 Spot of glue
62 Recess
63 Linear articulation
64 Part articulation
65 Section
66 Section
67 Transverse section
68 Collar end wall
69 Collar side tab
70 Collar side tab
71 Collar edge
72 Intermediate piece
73 Folding line
74 Punching

The invention claimed is:

1. A folding packet for cigarettes comprising a single-piece blank with main blank (14) for forming packet part (11) and lid, and with a collar (13), which is connected via two connecting webs (15, 16) to the packet part (11) of the main blank (14), with the connecting webs (15, 16) being connected to the main blank (14), namely to packet side walls (17, 19), by a web folding line (41, 42) running transversely to upright pack edges (39, 40), that is to say transversely to the connecting web (15, 16), characterized by the following features:

a) both connecting webs (15, 16) are connected to each other by a transverse web (43) to form a U-shaped unit, b) the unit of the two connecting webs (15, 16) with transverse web (43) is connected via the web folding lines (41, 42) to the lower edge of the packet side (17, 19), c) the collar (13) is laterally attached to one of the two connecting webs (15, 16), d) the collar (13) folded transversely to the connecting webs (15, 16) along a collar folding line (44) directed transversely to the web folding lines (41, 42) until the collar (13) abuts the unit comprising connecting webs (15, 16) and transverse web (43), e) the unit comprising connecting webs (15, 16), transverse web (43) and collar (13) is folded along the web folding lines (41, 42) until it comes into direct contact with the inner side of the main blank (14) in the region of the packet front wall (18) and the lid front wall (23).

2. The folding packet as claimed in claim 1, characterized in that the unit comprising collar (13), web folding lines (41, 42) and transverse web (43) is connected to the inner side of the main blank (14), namely a collar front wall (45) of the collar (13) by means of spot of glue (60) and the transverse web (43) by means of spot of glue (61), with both spots of glue (60, 61) being positioned in a region of the packet front wall (18).

3. The folding packet as claimed in claim 1, characterized by the following features:

a) the main blank (14) is configured according to a transverse folding principle.

b) a packet side wall (17) and a lid side wall (22) are attached to the edge of the main blank (14), namely in the region of packet front wall (18) and lid front wall (23), c) arranged opposite on the edge of the main blank (14) is a peripheral tab (21) with lid peripheral tab (30) for the connection to the packet side wall or lid side wall (22), and d) the connecting web (16) lying on the packet side wall (17) has a smaller width than the packet side wall (17) in such a way that the peripheral tab (21) in the region of the packet side wall (17) outside of the connecting web (16) makes direct and overlap-free contact with the packet side wall (17) and is connected thereto.

4. The folding packet as claimed in claim 3, characterized by the following features:

a) a collar tab (46) which faces the edge-side packet side wall (17) and the lid side wall (22) is configured with a smaller width, in accordance with the transverse dimensions of the connecting web (16), than the packet side wall (17), b) the peripheral tab (21) extends in the region of the collar (13) or in the region of the collar tab (46) outside of the latter while directly abutting the packet side wall (17), and c) the collar tab (46) has a projection (58), which extends approximately to the edge of the packet side wall (17), in order to provide a continuous oblique edge (59) as upper boundary of the collar (13).

5. The folding packet as claimed in claim 1, comprising extensions (56) or overlaps (57) which face the connecting webs (15, 16) and are arranged on the collar tabs (46, 47) and abut the free inner side of adjacent regions of the connecting webs (15, 16), and partially overlap the latter.

6. The folding packet as claimed in claim 1, characterized by the following features:

a) the lid (12) is connected pivotably to a packet side wall (17) by means of linear articulation (63), b) the collar (13) extends in the region of packet front wall (18), packet rear wall (20) and packet side wall (19) which lies opposite the packet side wall (17), and c) the collar (13) is connected to the connecting web (16) by an intermediate piece (72) which is dimensioned in such a way that a side edge of the collar (13) or a folding line (73) extends approximately in the region of a pack edge (39).

7. The folding packet as claimed in claim 6, characterized by the following features:

a) in a first folding step, the collar (13) with the intermediate piece (72) can be folded as a unit in the transverse direction along the collar folding line (44) with partial abutment against the connecting webs (15, 16) and the transverse web (43), and b) in a second folding step, the unit of collar (13), intermediate piece (72), connecting web (15, 16) and transverse web (43) can be folded against the inner side of the main blank (14).

8. The folding packet as claimed in claim 6, characterized in that the transverse web (43) connecting the connecting webs (15, 16) to one another has a trapezoidal configuration with an oblique edge corresponding to an obliquely running section (66) of a perforation line (26) for the delimitation of packet front wall (18) and lid front wall (23) such that the transverse web (43) abuts a collar side tab (69) below the section (66) of the perforation line (26).

9. A folding packet for cigarettes comprising a single-piece blank with main blank (14) for forming packet part (11) and lid, and with a collar (13), which is connected via two connecting webs (15, 16) to the packet part (11) of the main blank (14), with the connecting webs (15, 16) being connected to the main blank (14), namely to packet side walls (17, 19), by a web folding line (41, 42) running transversely to the upright pack edges (39, 40), that is to say transversely to the connecting web (15, 16), characterized by the following features:

a) both connecting webs (15, 16) are connected to each other by a transverse web (43) to form a U-shaped unit, b) the unit of the two connecting webs (15, 16) with transverse web (43) is connected via the web folding lines (41, 42) to the lower edge of the packet side (17, 19), c) the collar (13) is laterally attached to one of the two connecting webs (15, 16) and delimited from the connecting web (15, 16) by a collar folding line (44) running parallel to the upright pack edges (39, 40), that is to say transversely to the web folding lines (41, 42), d) due to two successive folds steps, the collar comes into direct contact with the inner side of the main blank (14) in the region of packet front wall (18) and lid front wall (23), with the collar (13) folded along the collar folding line (44) in a direction transverse to the pack edges (39, 40) until the collar (13) abuts the connecting webs (15, 16) and the transverse web (43), and a unit comprising collar (13), connecting webs (15, 16) and transverse web (43) is folded along the transverse web folding lines (41, 42) against the inner side of the main blank.

* * * * *